US007413096B2

(12) United States Patent
Morgan et al.

(10) Patent No.: US 7,413,096 B2
(45) Date of Patent: Aug. 19, 2008

(54) BEVERAGE CONTAINER HAVING A SQUEEZE-ACTUATED SELF-SEALING VALVE

(75) Inventors: Michael V. Morgan, Laguna Beach, CA (US); Ronald K. Bergold, Mission Viejo, CA (US)

(73) Assignee: Whirley Industries, Inc., Warren, PA (US)

( * ) Notice: Subject to any disclaimer, the term of this patent is extended or adjusted under 35 U.S.C. 154(b) by 196 days.

(21) Appl. No.: 10/847,155

(22) Filed: May 17, 2004

(65) Prior Publication Data

US 2005/0029265 A1 Feb. 10, 2005

Related U.S. Application Data

(60) Provisional application No. 60/470,624, filed on May 15, 2003.

(51) Int. Cl.
*B65D 43/12* (2006.01)
*B65D 43/26* (2006.01)
*A47G 19/22* (2006.01)

(52) U.S. Cl. ..... 220/254.9; 220/715; 220/262; 220/345.3; 222/470; 222/518

(58) Field of Classification Search ..... 220/254.9, 220/262, 264, 345.1, 345.3, 345.4, 348, 351, 220/714, 715; 222/213, 470, 518
See application file for complete search history.

(56) References Cited

U.S. PATENT DOCUMENTS 2,578,201 A * 12/1951 Nicorvo ..... 215/315
3,107,035 A * 10/1963 Cholet ..... 222/213
3,275,194 A * 9/1966 Moulder ..... 222/48
3,684,120 A 8/1972 Beeman
3,698,868 A 10/1972 Bilichniansky
3,964,631 A * 6/1976 Albert ..... 220/715
3,967,748 A * 7/1976 Albert ..... 220/715
3,972,443 A * 8/1976 Albert ..... 220/715
4,074,827 A 2/1978 Labe, III
4,094,433 A * 6/1978 Numbers ..... 220/715
4,099,642 A * 7/1978 Nergard ..... 220/715

(Continued)

FOREIGN PATENT DOCUMENTS

EP 0 444 990 A1 9/1991

OTHER PUBLICATIONS

Article from Thermo-Serv website: www.thermoserv.com; 2 pages, Aug. 17, 2004.

*Primary Examiner*—Anthony D Stashick
*Assistant Examiner*—James N Smalley
(74) *Attorney, Agent, or Firm*—The Bilicki Law Firm, P.C.; Rebecca M.K. Tapscott, Esq.; Byron A. Bilicki, Esq.

(57) ABSTRACT

A beverage container includes a squeeze-actuated self-sealing valve. An actuation mechanism is disposed between inner and outer walls of the cup portion. The actuation mechanism is acted upon by squeezing the beverage container. The actuation mechanism moves a sliding plate in the cover to expose an opening along a front end of the cover for drinking from the beverage container. When not in use, a biasing mechanism in the actuation mechanism causes the sliding plate of the self-sealing valve to return to the closed position.

5 Claims, 8 Drawing Sheets

U.S. PATENT DOCUMENTS 4,121,731 A * 10/1978 Okerstrum ..... 220/715
4,212,408 A * 7/1980 Valenzona ..... 220/254.5
4,276,992 A * 7/1981 Susich ..... 220/254.5
4,303,173 A * 12/1981 Nergard ..... 220/254.5
4,457,453 A * 7/1984 Stevens et al. ..... 222/48
4,469,250 A 9/1984 Evezich
5,199,597 A * 4/1993 Gladish ..... 220/715
5,280,844 A 1/1994 Kaufman et al.
5,307,950 A * 5/1994 Li ..... 220/714
5,332,121 A 7/1994 Schmidt et al.
5,485,938 A * 1/1996 Boersma ..... 220/714
5,711,452 A 1/1998 Chaffin
6,098,834 A * 8/2000 Hatsumoto et al. ..... 220/715
6,152,862 A 11/2000 Hobbs
6,336,574 B1 * 1/2002 Hins ..... 222/518
6,375,046 B1 4/2002 Alleard et al.
6,460,739 B1 10/2002 Norris et al.
6,557,717 B1 * 5/2003 Keck ..... 220/254.9

* cited by examiner

BEVERAGE CONTAINER HAVING A SQUEEZE-ACTUATED SELF-SEALING VALVE

RELATED APPLICATIONS

The present application claims priority under 35 U.S.C. sctn. 119(e) to U.S. Provisional Patent Application No. 60/470,624, filed May 15, 2003.

BACKGROUND OF THE INVENTION

Field of the Invention

The present invention relates to beverage containers, and in particular to a beverage container having a manually operable valve for unsealing an opening.

DETAILED DESCRIPTION OF THE EMBODIMENTS

In one embodiment, a beverage container having a self-sealing valve comprises a cup portion formed with a bottom end, a top end and an inner wall defining an interior volume. A cover is adapted for engagement with the top end of the cup portion and the cover is formed with an opening for drinking therethrough. A slidable valve assembly is provided in the cover for sealing the opening when not in use. An actuation mechanism is mounted along the first wall and is coupled to the valve assembly for moving the valve assembly when the cup portion is squeezed by the user.

In another embodiment, a biaser or resilient member is provided for urging the valve assembly into a closed position such that the opening is sealed in the absence of an external force.

In another embodiment, the cup portion further desirably comprises an outer wall and the actuation mechanism is disposed between the inner and outer walls. The actuation mechanism comprises a pivoting mechanical lever for sliding the sliding plate relative to the cover.

In yet another embodiment, the outer wall is desirably formed with a cut-way portion and a resilient material is disposed over the cut-away portion. The resilient material is preferably made of a deformable material for allowing the user to apply a force to the actuation mechanism.

The embodiments described herein provide a beverage container comprising a cup portion and a cover incorporating a self-sealing valve. The self-sealing valve provides a convenient mechanism for sealing the interior volume of the beverage container to help insulate the beverage and prevent accidental spills. The beverage container may be used with hot or cold beverages.

Figure 1:
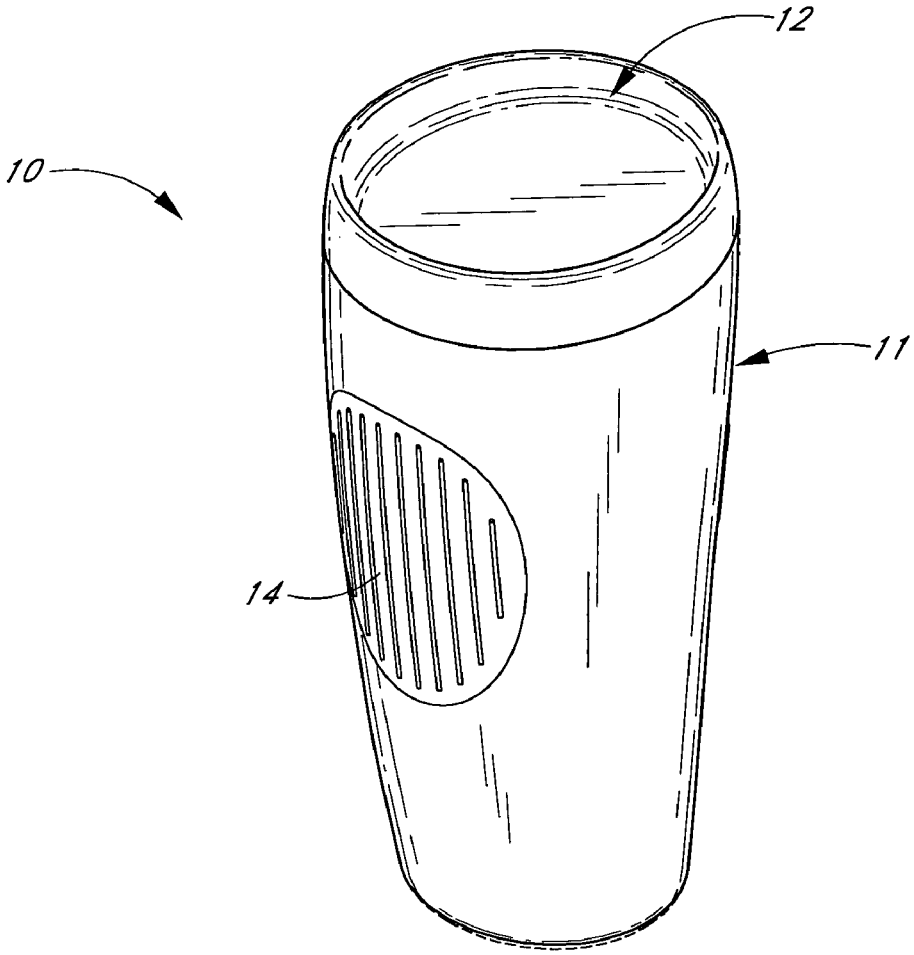
FIG. 1 is a perspective view of a beverage container including a self-sealing valve mechanism according to one embodiment of the present invention.
Figure 2:
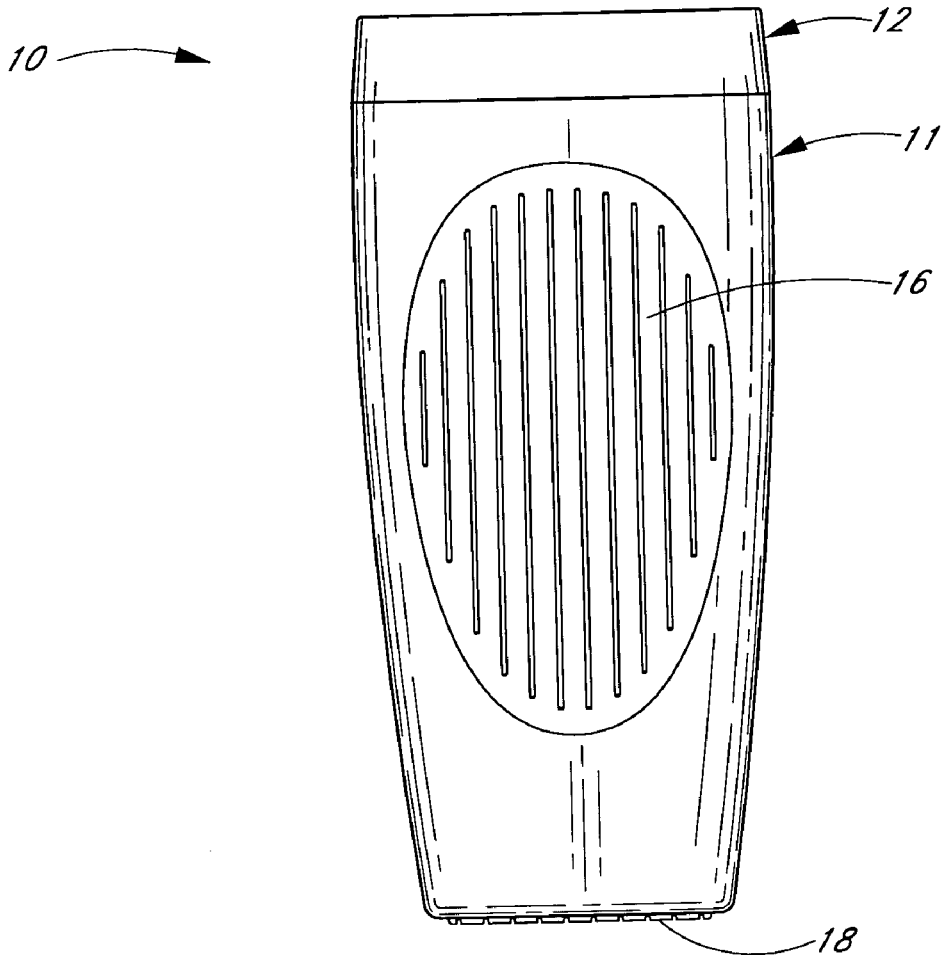
FIG. 2 is a rear view of the beverage container shown in FIG. 1.

With reference to FIG. 1, for purposes of illustration, one is illustrated in the form of a beverage container 10 generally including a cup portion 11 and a cover 12. A front grip portion 14 is disposed along a front side of cup portion 11. As shown in FIG. 2, a corresponding rear grip portion 16 is disposed along the rear side of the cup portion 11. Front and rear grip portions 14, 16 may be provided with textured surfaces for allowing the user to grip beverage container 10 in a comfortable and secure manner. Rear grip portion 16 may be made of a deformable material, as will be described in more detail below.

Figure 3:
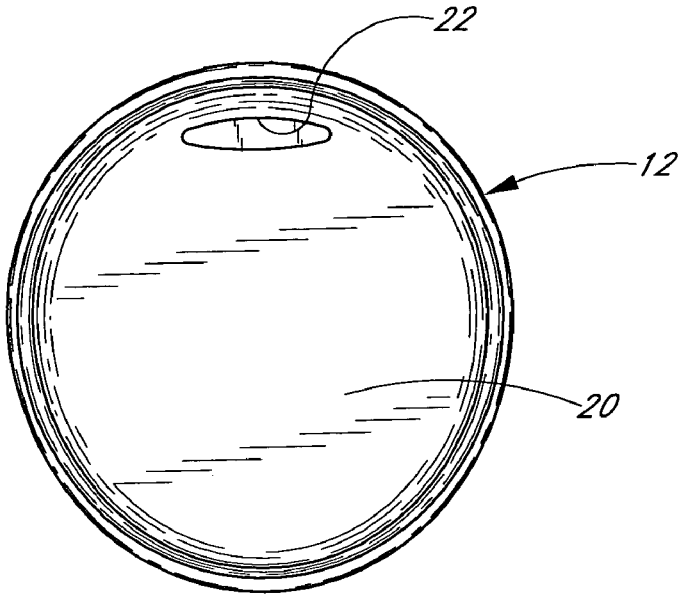
FIG. 3 is a top view of the beverage container shown in FIG. 1.
Figure 4:
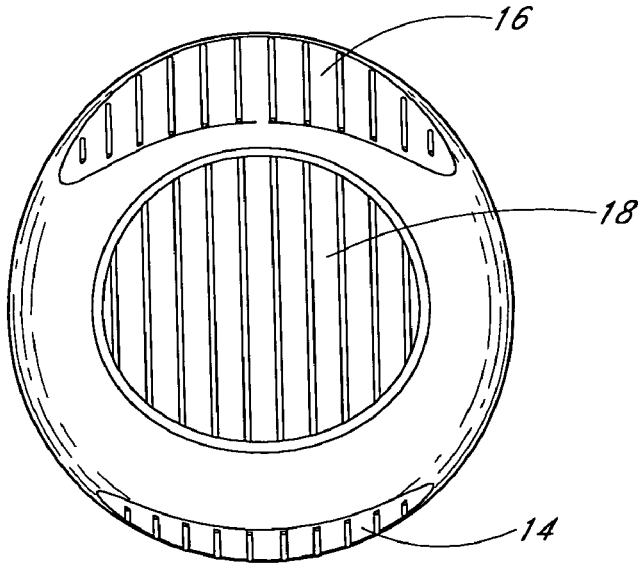
FIG. 4 is a bottom view of the beverage container shown in FIG. 1.
Figure 6:
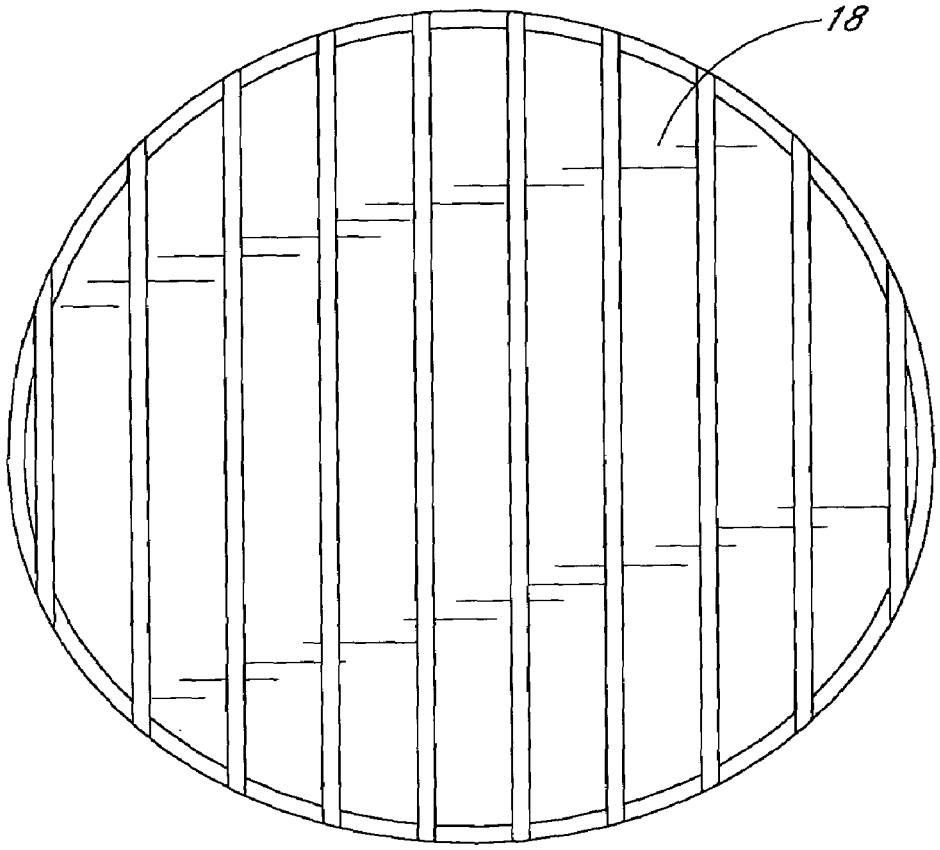
FIG. 6 is a plan view of a bottom pad used with the beverage container of FIG. 1.
Figure 7:
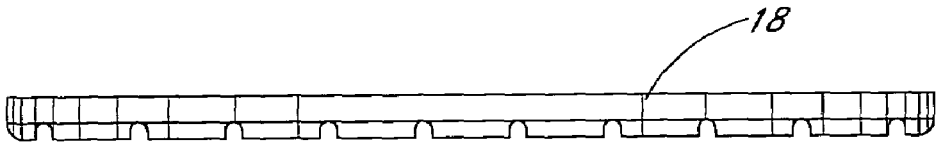
FIG. 7 is a side view of the bottom pad of FIG. 6.
Figure 11:
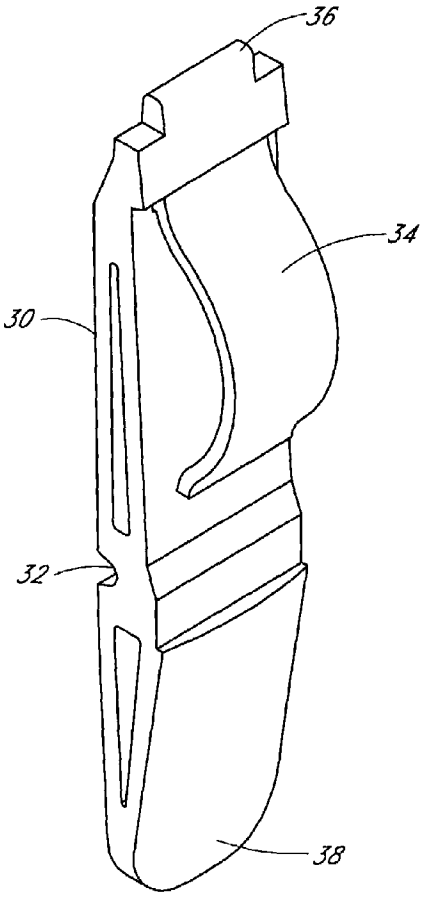
FIGS. 8-11 illustrate various views of a lever which is used to actuate the self-sealing valve mechanism.
Figure 10:
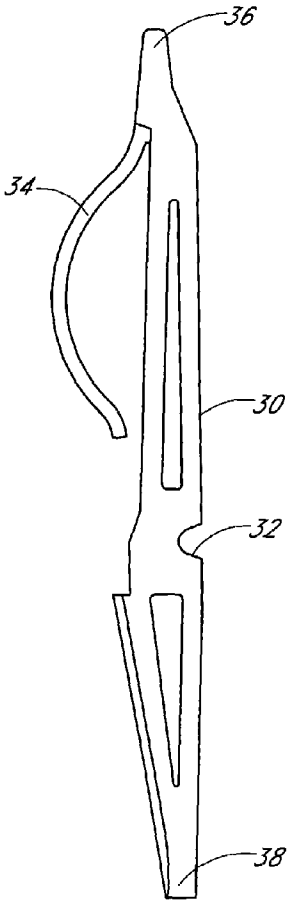
Figure 9:
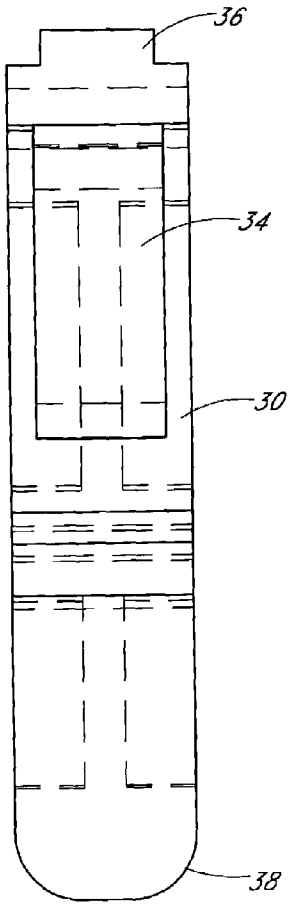
Figure 8:
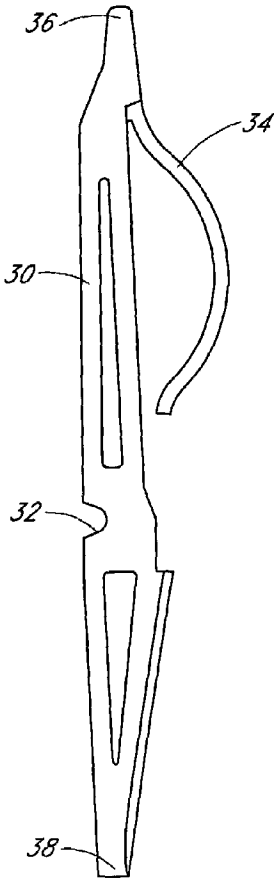

As shown in the top view of FIG. 3, cover 12 is formed with an opening 22 extending through a substantially disc-shaped center portion 20. Illustrated opening 22 takes the form of an elongated slot that provides an exit port for allowing the contents of the beverage container to flow out from the interior volume of cup portion 11. With reference now to FIG. 4, a bottom view of beverage container 10 illustrates a contoured bottom pad 18 for preventing the beverage container from slipping or skidding. Front and back grip portions 14, 16 can also be seen in FIG. 4. FIGS. 6 and 7 provide plan and side views of an embodiment of the bottom pad 18.

Figure 5:
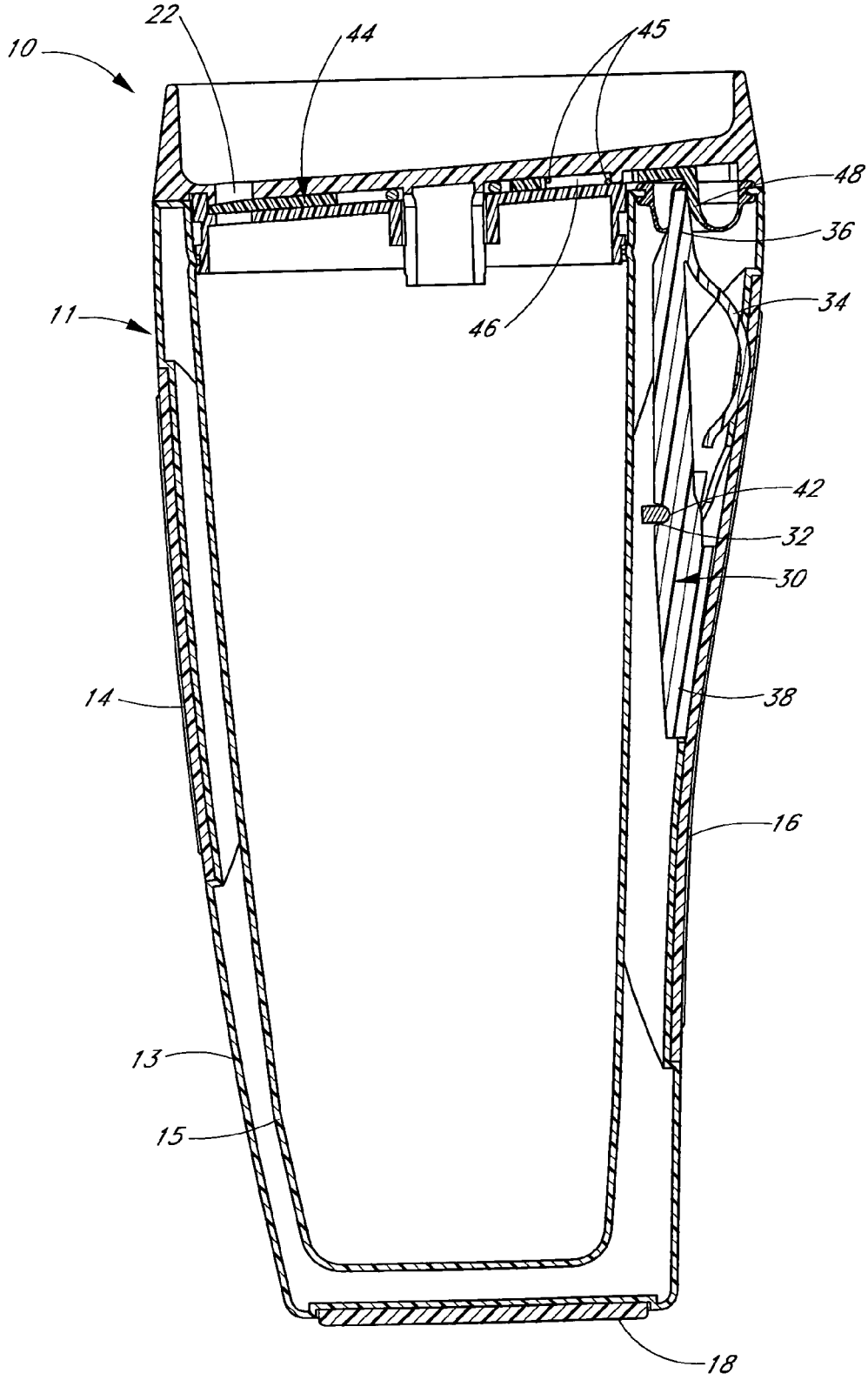
FIG. 5 is a cross-sectional view of the beverage container shown in FIG. 1 illustrating the various components of a self-sealing valve mechanism.

With reference now to FIG. 5, a cross-sectional view of beverage container 10 is shown. Cup portion 11 includes an outer wall 13, an inner wall 15, and an actuation mechanism 30 disposed in the gap between the inner and outer walls. Inner wall 15 defines the interior volume of cup portion 11. Outer wall 13 defines the exterior surface of cup portion 11. Inner and outer walls 15,13 are preferably made of stainless steel or any other suitable material. The gap between outer wall 13 and inner wall 15 provides enhanced thermal resistance for insulating the contents of the beverage container, thereby reducing the amount of heat exchange with the environment. Cover 12 is preferably adapted to engage an upper end of outer wall 13 of cup portion 11 in a threaded or friction fit relationship for attachment thereto. It will be appreciated, however, that cover 11 could alternatively be adapted to engage an upper end of inner wall 15 of cup portion 11 in a threaded or friction fit relationship for attachment thereto.

Actuation mechanism 30 is configured for moving a valve assembly in cover 12 for unsealing the opening. Actuation mechanism 30 is preferably located along the rear side (i.e. diametrically opposed to the opening) of cup portion 11 between outer wall 13 and inner wall 15. FIGS. 8-11 illustrate various views of one actuation mechanism comprising a lever 30 having a top end 36, a bottom end 38, a biasing spring 34 and an indent 32.

With reference again to FIG. 5, indent 32 of lever 30 receives a pivot pin 42 such that lever 30 is rotatably coupled to cup portion 11. Outer wall 13 of cup portion 11 is preferably formed with a cut-away region (i.e., an opening) for allowing the user to apply a force along a bottom end 38 of lever 30. Rear grip portion 16 is disposed over the cut-away region in cup portion 11 and may be made of a deformable, resilient material that provides for secure gripping and a desirable tactile sense.

Figure 14:
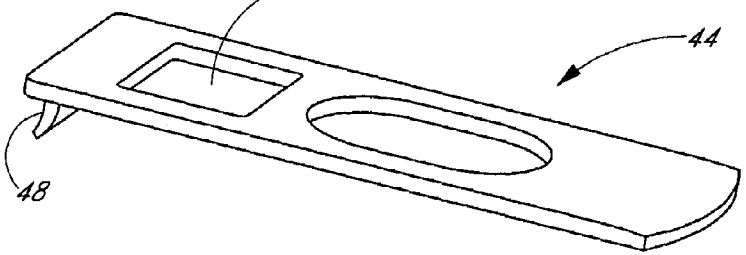
FIGS. 12-14 illustrate various views of the sliding plate which forms a part of the self-sealing valve mechanism.
Figure 13:
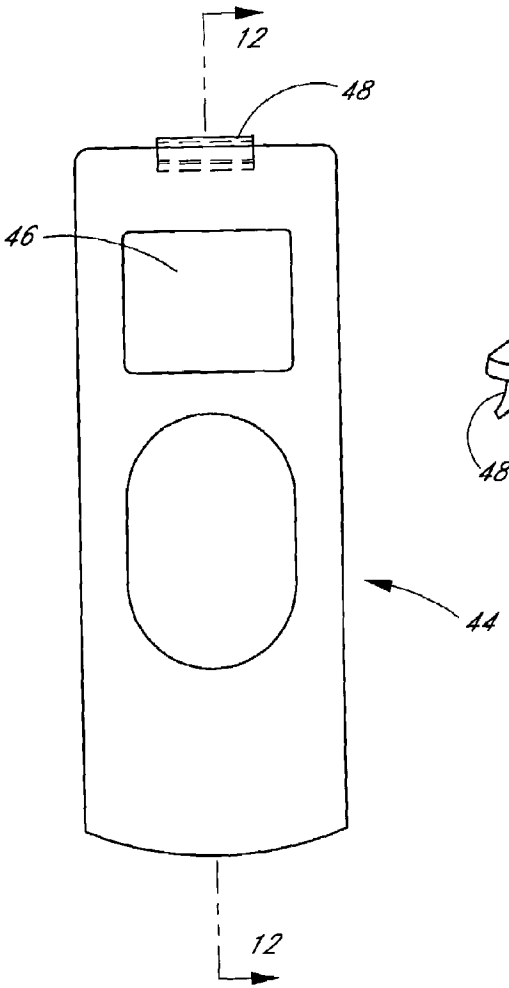
Figure 12:
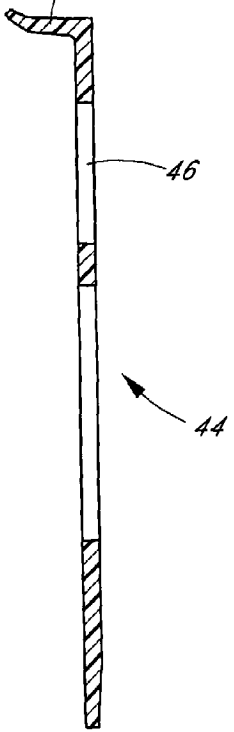

With reference now to FIGS. 12-14, the valve assembly generally comprises an elongate sliding plate 44 with a lip portion 48 extending downward along a rear end portion of the sliding plate. The sliding plate may be formed with a gap 46 for housing a return spring, as will be described in more detail below.

With reference again to FIG. 5, sliding plate 44 is slidably disposed within cover 12. With cover 12 located on cup portion 11, a top end 36 of lever 30 is located adjacent lip portion 48 of sliding plate 44. Rubber gasket 40 provides a seal to prevent external fluid from entering the gap between inner wall 15 and outer wall 13. A return spring 45 or other resilient member is preferably provided within gap 46 formed in sliding plate 44. Return spring 45 is configured for urging sliding plate 44 into the closed position, thereby providing a self-sealing valve assembly.

In operation, the user removes cover 12 from cup portion 11 to fill the interior volume of the cup portion with a liquid beverage. Cover 12 is then placed back on the top end of cup portion 11 by engaging the cover with the cup portion in a threaded or friction fit relationship. In this position, a first engagement surface defined by top end 36 of lever 30 and desirably facing outer wall 13 is adjacent to or in engagement with a second engagement surface, which is defined by lip portion 48 of sliding plate 44 and desirably facing away from outer wall 13. Gap 46 between inner wall 15 and outer wall 13 of cup portion 11 provides thermal resistance to reduce the heat loss from the contents of cup portion 11. When the user is not drinking from the beverage container, the self-sealing valve is in the closed position to further insulate the contents and prevent accidental spills. When picking up beverage container 10, the user grasps cup portion 11 around the mid-section in a natural manner as he or she would whenever holding a cup. When it is desired to drink from beverage container 10, the user squeezes cup portion 11 and, more particularly, applies an external force to rear grip portion 16 of beverage container 10.

Figure 5A:
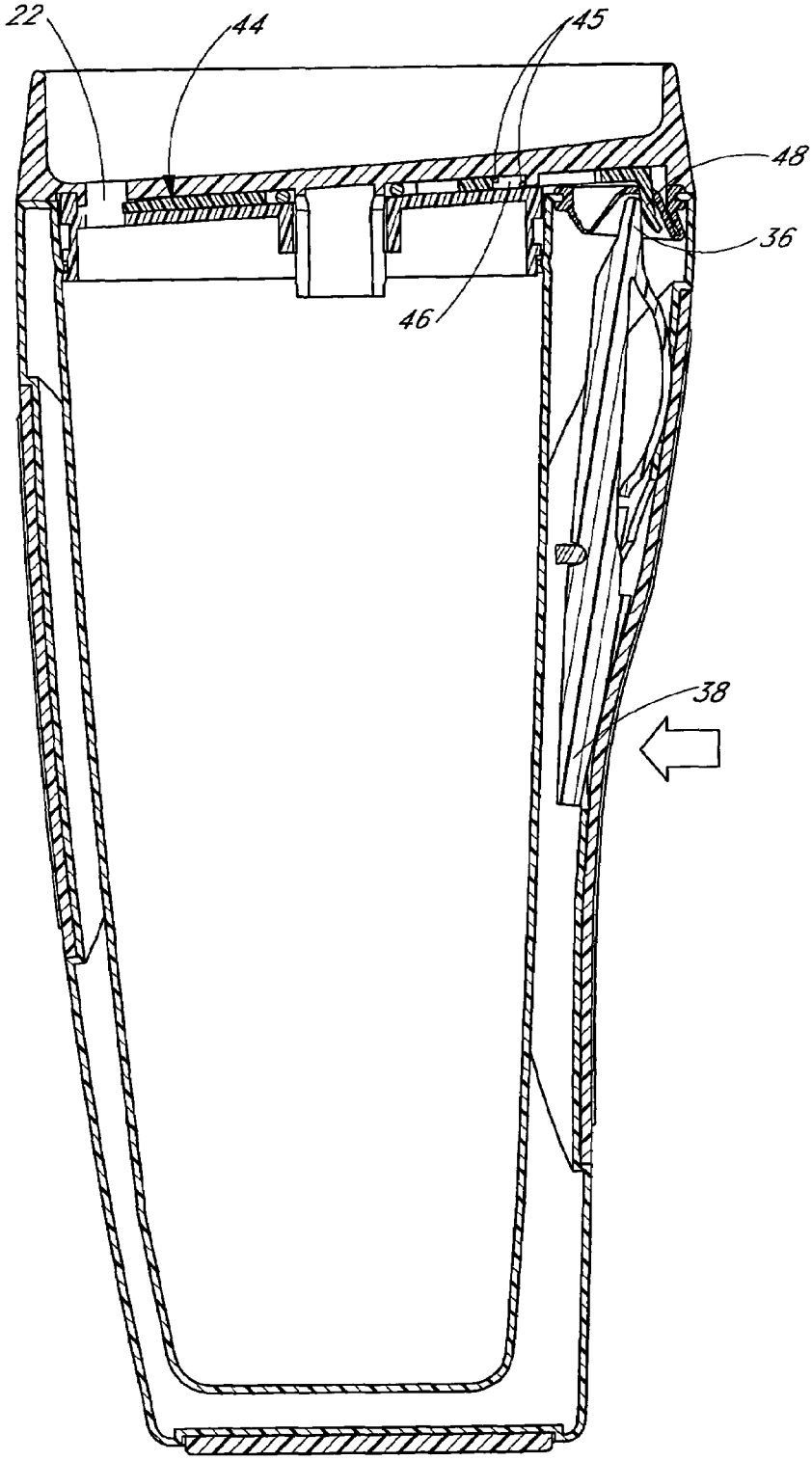
FIG. 5A is a cross-sectional view illustrating the beverage container with the valve in the open position.

With reference now to FIG. 5A, rear grip portion 16 deforms inward and thereby pushes bottom end 38 of lever 30 inward (i.e., toward the inner wall 15). The inward movement of bottom end 38 of lever 30 causes lever 30 to rotate about pivot pin 42. As a result, top end 36 of lever 30 moves in a rearward direction (i.e., toward outer wall 13). Because top end 36 of lever 30 is in engagement with lip portion 48 of sliding plate 44, lever 30 causes sliding plate 44 to slide in a rearward direction relative to fixed portion of cover 12. Specifically, the force of the first engagement surface against the second engagement surface causes sliding plate 44 to move. It will be recognized that, in order the achieve this, the user must apply a sufficient force to overcome the force of biasing spring 34 acting on lever 30 and the force of return spring 45 acting on sliding plate 44. As sliding plate 44 slides in a rearward direction, opening 22 in cover 12 is unsealed and the user may then sip the contents of beverage container 10 through opening 22. When the force applied by the user to the bottom end of lever 30 is removed, biasing spring 34 causes lever 30 to pivot back to the resting position. In addition, return spring 45 in cover 12 causes sliding plate 44 to move forward to reseal opening 22. As a result, when the user is not "squeezing" beverage container 10, sliding plate 44 reseals opening 22, as shown in FIG. 5, thereby providing a convenient self-sealing valve mechanism.

The arrangement of components described above provides a improved beverage container having a well-insulated cup portion and a self-sealing opening that is very convenient to operate. The actuation mechanism is located within the cup portion, rather than on the cover, for allowing the user to maintain a comfortable hand position while operating the self-sealing valve. The actuation mechanism (e.g., lever) is releasably coupled to the self-sealing valve such that the cover may be removed and replaced for filling the cup portion. Furthermore, the actuation mechanism is preferably located between the inner and outer walls for providing an integrated unit that is easy to clean and provides a pleasing appearance.

It will be appreciated by those skilled in the art that a beverage container constructed according to the present invention may be manufactured from a wide variety of different materials. In one embodiment, the inner and outer walls of the cup portion are made of a durable material, such as, for example, stainless steel. The cover may be manufactured from a plastic, such as, for example, polypropylene, PET or polyethylene. The front and rear grip portions and the bottom cap may be manufactured from thermoplastic elastomer (TPE).

In one alternative embodiment of the present invention, the beverage container may be provided without an outer wall. In this embodiment, the actuation mechanism is mounted along an exterior portion of the inner wall. A biasing spring or other mechanism may be located between the inner wall and the bottom end of the lever, or in any other suitable location, for moving the lever back into the resting position.

In another alternative embodiment, a button or other extension may extend through the outer wall for enabling the user to move the bottom end of the lever. In this embodiment, the user may depress the button to rotate the lever and thereby actuate the valve assembly. It should also be appreciated that any mechanism wherein the mug may be squeezed for causing the valve assembly to move is intended to be within the scope of the invention.

In yet another alternative embodiment, the beverage container may include a squeeze-actuated self-sealing valve that operates on electrical power. In this embodiment, the act of squeezing the cup portion triggers an electrically-powered motor to move the valve assembly to unseal the opening.

While the foregoing detailed description has described several embodiments of the apparatus of the present invention, it is to be understood that the above description is illustrative only and is not limiting of the disclosed invention. It will be appreciated that the specific features of the invention can differ from those described above while remaining within the scope of the present invention.

What is claimed is:

1. A beverage container having a self-sealing valve, comprising:

a cup portion formed with a bottom end, a top end and a first wall defining an interior volume and an outer wall;

a cover adapted for engagement with said top end of said cup portion, said cover being formed with an opening extending therethrough;

a valve assembly slidably disposed along said cover and having an open position and a closed position, said valve being positioned to seal said opening when in said closed position, said valve being positioned to unseal said opening when in said open position;

an actuator positioned adjacent to an exterior surface of said first wall of said cup portion, said actuator being coupled to said valve assembly and configured to move said valve assembly into said open position in response to an external force; and a resilient member disposed along said cover for urging said valve assembly into said closed position;

wherein said actuator includes a lever having a top end and a bottom end, said top end of said lever being selectively coupled to said sliding plate for sliding said sliding plate relative to said cover, said lever being adapted to rotate about a pivot pin; and wherein said outer wall has an opening provided therethrough for allowing a user to apply a force along said bottom end of said lever and said opening is provided along a mid-section of said cup portion and said cup portion is configured to be squeezed by a user for applying the force and a deformable rear grip portion disposed along said outer wall and covering said opening.

2. A squeezable beverage container having a self-sealing valve, comprising:

a cup portion formed with an inner wall and an outer wall, said inner first wall defining an interior volume for holding a beverage;

a cover adapted for engagement with a top end of said cup portion, said cover being formed with an opening for allowing said beverage to pass through;

a sliding plate disposed along said cover, said sliding plate having an open position for uncovering said opening and a closed position for covering said opening; and a pivoting mechanical lever disposed between said inner and outer walls of said cup portion, said mechanical lever having a top end and a bottom end, said top end of said mechanical lever being configured for moving said sliding plate from said closed position to said open position, said bottom end of said mechanical lever being configured to be acted upon by a user for pivoting said mechanical lever.

3. The squeezable beverage container of claim 2, further comprising a resilient member for urging said sliding plate into said closed position.

4. The squeezable beverage container of claim 2, further comprising a cut-away portion of said outer wall for allowing said user to act upon said bottom end of said mechanical lever.

5. The squeezable beverage container of claim 4, further comprising a deformable material disposed along said outer wall and covering said cut-away portion.

* * * * *